United States Patent [19]

Dietzel et al.

[11] 4,115,145

[45] Sep. 19, 1978

[54] DIFFUSION TOWER FOR SUGAR BEET COSSETTES

[75] Inventors: Walter Dietzel, Braunschweig; Martin Athenstedt, Sehnde, both of Fed. Rep. of Germany

[73] Assignee: Braunschweigische Maschinenbauanstalt, Braunschweig, Fed. Rep. of Germany

[21] Appl. No.: 812,618

[22] Filed: Jul. 5, 1977

[51] Int. Cl.[2] ..... C13D 1/12

[52] U.S. Cl. ..... 127/5; 127/7; 422/273

[58] Field of Search ..... 127/3, 5, 7; 23/270 R

[56] References Cited

U.S. PATENT DOCUMENTS

| | | | |
|---|---|---|---|
| 3,142,589 | 7/1964 | Schaffer | 127/3 |
| 3,477,873 | 11/1969 | Koelsch | 127/3 X |
| 3,726,715 | 4/1973 | Mushack | 127/5 |
| 3,794,521 | 2/1974 | Dietzel | 127/5 |
| 3,880,667 | 4/1975 | Straube | 127/3 X |
| 3,953,224 | 4/1976 | Dietzel | 127/5 |

*Primary Examiner*—Sidney Marantz

*Attorney, Agent, or Firm*—W. G. Fasse; W. W. Roberts

[57] ABSTRACT

A diffusion tower for sugar beet cossettes is provided with a cossettes feed-in mechanism which includes at least one, preferably a plurality, of slots in the bottom of the tower housing. Each slot extends at an angle to the radial direction and is connected to a feed device or supply conduit for supplying a mixture of sugar beet cossettes and juice into the lower end of the tower housing. A screening feed screw may be arranged to return sugar beet cossettes into the tower to thereby facilitate the juice extraction.

13 Claims, 4 Drawing Figures

DIFFUSION TOWER FOR SUGAR BEET COSSETTES

BACKGROUND OF THE INVENTION

The present invention relates to extraction towers for sugar beet cossettes. Such towers comprise a hollow cylinder forming an upright tower housing. The inner wall of the housing may be provided with baffles. Concentrically in the housing there is arranged a conveyor shaft for rotation in the housing and for transporting the cossettes upwardly through the tower by means of conveyor or transport wings. The lower end of the conveyor shaft is equipped with cossettes distributing means adjacent to the bottom of the tower housing. Feed means are arranged to supply a mixture of cossettes and juice into the lower end of the tower and juice extraction means are also connected to the lower end of the tower. Cossettes discharge means are arranged at the upper end of the tower for removing the leached cossettes from the tower. Further, leaching liquid supply means are also arranged at the upper ends of the tower.

Extraction towers of the just described type have been constructed in the past for ever increasing throughput capacities calling respectively for ever increasing dimensions. However, such increasing dimensions result in problems regarding the uniform distribution of the cossettes as well as of the flow of the juice in the bottom area of the tower. It has been found, that such problems cannot be properly solved by the prior art feed-in devices for the cossettes and by the juice extraction devices known heretofore.

It has been customary heretofore for a long time to supply the sugar beet cossettes into the lower tower area near the bottom of the tower through an opening in the vertical tower housing adjacent to the bottom thereof. This may be accomplished through supply conduit means directly connected to the bottom area of the tower housing through the lateral wall thereof. Another way of accomplishing this feed supply is disclosed in German Patent Publication (DOS) No. 2,106,464, wherein a screening feed screw is employed for this purpose. However, where large tower diameters are involved, it is to be expected and hardly avoidable that inside the tower directly adjacent to the inlet port cossettes accumulate at least temporarily. Such accumulation of cossettes will be distributed only when the cossettes distributing device rotating with the conveyor shaft enters into and passes through the area of cossettes accumulation. The proper leaching and juice extraction is at least impeded during such accumulation of cossettes since the intense cossettes liquid contact does not take place in such accumulations, whereby the total extraction time is prolonged and the total length of the contact path between cossettes and leaching liquid is reduced.

German Patent Publication (DAS) No. 1,003,660 suggests to construct the cossettes feed-in mechanism as a screening conveyor screw arranged below the tower bottom as an extension of the rotational axis of the conveyor shaft of the tower. However, this suggestion cannot be realized in practice because the area in which the cossettes juice mixture would have to be fed into the tower by the screening conveyor screw, is taken up by the guide bearing of the transport shaft. Further, the transport or conveyor shaft in extraction towers of large dimensions also take up a substantial space and thus would substantially overlap the outer diameter zone of the screening feed screw in the radial direction. Even if this problem could be solved, the result would still not be a uniform feeding of the mixture of sugar beet cossettes and juice into the tower because the supply of the mixture into the tower would take place radially inwardly adjacent to the outer diameter area of the conveyor shaft, whereby again an accumulation of cossettes, even if it is only temporary, could not be avoided. The mere difference would be, that the accumulation which in the above described German Patent Publication No. 2,106,464 takes place in the area adjacent to the outer housing walls, has been shifted to an inner or central area adjacent to the conveyor shaft of the tower.

German Patent Publication No. H 11,005 discloses a feed supply device which supplies the mixture of cossettes and juice into the tower at the bottom thereof in such a manner that the mixture is uniformly distributed over the whole radial area of the tower. However, this type of prior art device is suitable only for extraction towers with limited dimensions. Thus, this type of device cannot be used in an economical manner in extraction towers of large and largest or maximum dimensions. This is so because in the apparatus of German Patent Publication No. H 11,005 the feed-in takes place through the conveyor shaft. For this purpose, a cossettes distributor arm is secured to the lower end of the conveyor shaft. A conduit supplies the mixture of cossettes and juice to the rear side of the distributor arm which rotates with the conveyor shaft. However, with the increasing dimensions of a diffusion tower, the cross sectional areas required for the transport of the cossette juice mixture also become larger and larger, which poses substantial problems for the construction of a liquid-tight, rotatable coupling for the feed supply pipe. Further problems are encountered in designing the cross sectional area of the cossettes distributor arm because with the increasing surface area of the distributor arm, there also increases the resistance against the movement of this arm through the tower as well as its displacement effect which occurs during the rotation of the distributor arm within the cossette juice mixture in the tower bottom area.

OBJECTS OF THE INVENTION

In view of the foregoing, it is the aim of the invention to achieve the following objects, singly or in combination:

to avoid the drawbacks of the prior art, more specifically, to provide a uniform distribution of the cossettes juice mixture supplied into the bottom area of the tower;

to assure a uniform mixture distribution at reasonable costs and without interfering with an efficient juice extraction;

to assure uniform cossettes and juice distribution independently of the dimensions of an extraction tower;

to arrange the feed supply means relative to the bottom surface area of the tower in such a manner that a control of the supplied mixture is possible, for example, with regard to a retarding effect, or with regard to the flow direction of the mixture radially inwardly or radially outwardly, relative to the tower housing; and to facilitate the juice extraction by connecting a screening feed screw to the lower end of the tower housing and supplying such feed screw with a cossette juice mixture taken from the lower housing zone at a point upstream of the point where the screening feed screw is connected to the tower housing.

SUMMARY OF THE INVENTION

According to the invention, an extraction tower is provided at its bottom with a cossettes and juice mixture feed-in device comprising slot means extending in the tower bottom between the conveyor shaft and the tower housing. Preferably, at least one slot is provided which extends at an angle to the direction of a radius of the tower. Where a plurality of slots are provided, they will also extend at such an angle, and preferably, the slots would be uniformly spaced from each other around the bottom of the tower. A feed-in conduit is connected to the slot or to the slots in common.

According to the invention, there is further provided a screening conveyor screw connected to the tower wall at the bottom of the tower and supplied by a feed conduit which receives cossette and juice mixture at a point upstream of the point where the feed screw is connected to the tower and supplies the mixture to the radially outer end of the feed screw, whereby a suction effect is caused inside the tower bottom area which facilitates the uniform distribution of the mixture over the bottom of the tower, and which also facilitates the juice removal from the tower.

BRIEF FIGURE DESCRIPTION

In order that the invention may be clearly understood, it will now be described, by way of example, with reference to the accompanying drawings, wherein.

Figure 1:
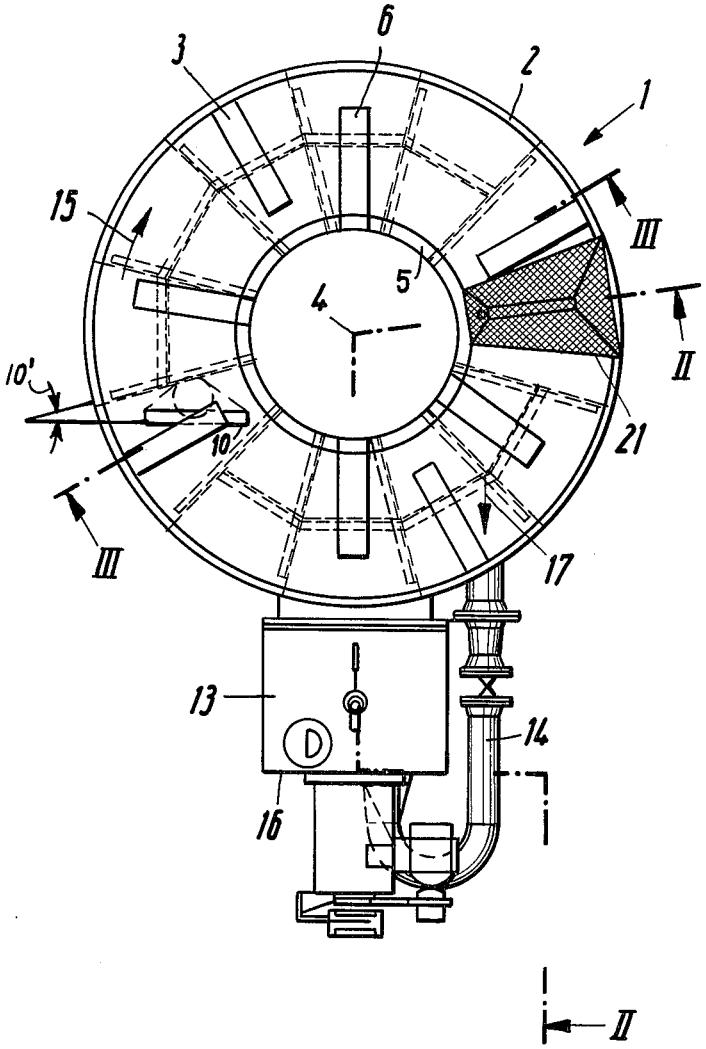
FIG. 1 shows a top plan view of a tower according to the invention axially in the direction of the central tower axis with the top of the tower removed.

DETAILED DESCRIPTION OF PREFERRED EXAMPLE EMBODIMENTS:

The figures show a diffusion tower 1 for sugar beet cossettes comprising an outer, upright housing 2 of a hollow cylindrical configuration. The inner walls of the housing 2 are equipped, for example, with baffles 3 extending radially inwardly toward the cylinder axis 4. A conveyor shaft 5 is supported for rotation in the center of the housing 2. Conveying wings 6 are secured to the conveyor shaft 4 and extend radially outwardly for transporting the mixture of cossettes and juice upwardly through the tower means 1. Distributor blades 7 and/or scrapers 8 are secured to the lower end of the conveyor shaft adjacent to the bottom 9 of the tower housing. The bottom 9 closes the lower end of the tower housing 2. The bottom may be either unperforated as shown, or it may be constructed as a screen bottom which may be either made entirely of screening material or it may be provided with a limited screening surface or surfaces.

Figure 2:
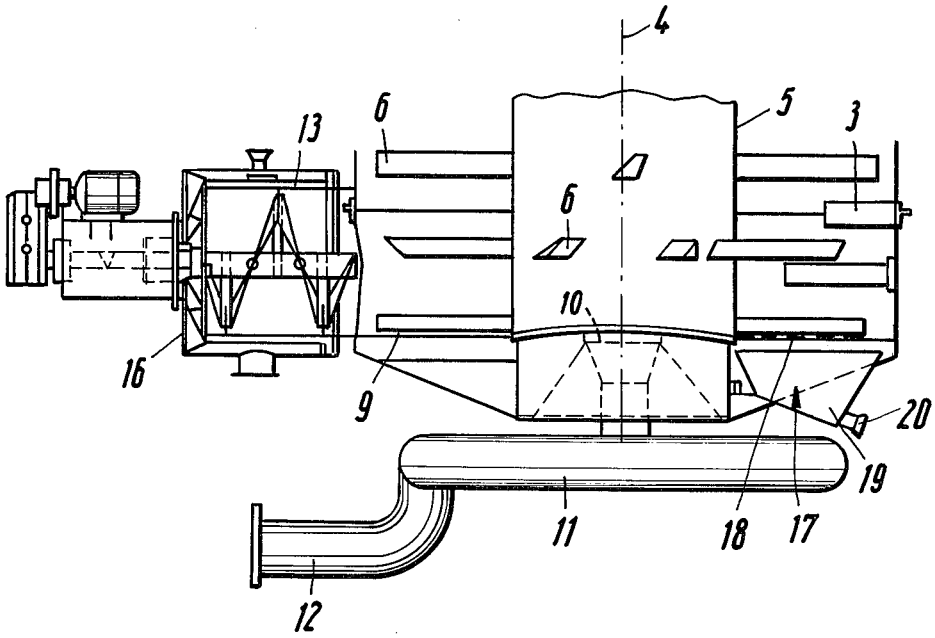
FIG. 2 is a somewhat schematic section through the lower end of the tower, whereby the section extends along section line II — II in FIG. 1.
Figure 3:
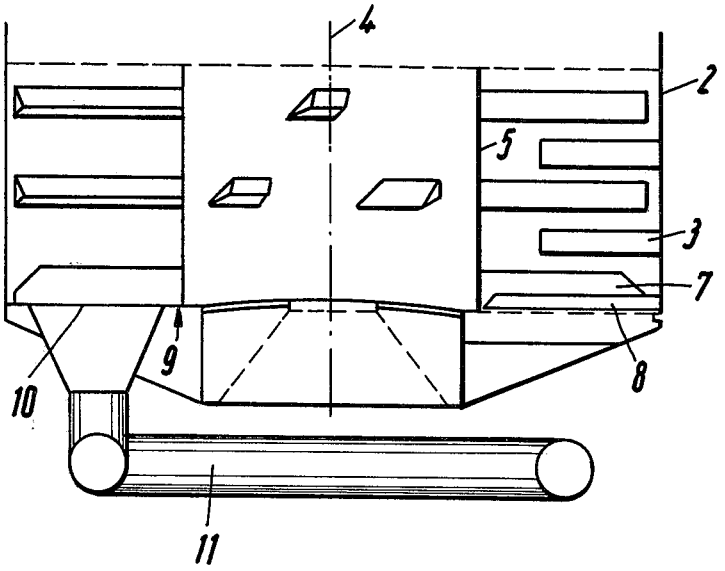
FIG. 3 illustrates a sectional view through the bottom of the tower along section line III — III in FIG. 1.
Figure 4:
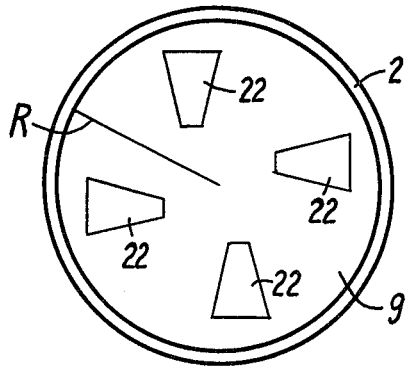
FIG. 4 shows a simplified plan view of the bottom of a tower illustrating a modification according to the invention, whereby the view is again along the rotational axis of the tower, and whereby all elements except the tower bottom have been omitted for clarity.

According to the invention, a feeding slot 10 is provided in the bottom 9 of the tower housing 2 for supplying the cossettes juice mixture into the tower housing 2. As shown, the slot 10 has a narrow, rectangular shape and extends between the outer housing wall and the conveyor shaft, however, at an angle 10' relative to the radial direction, as shown in FIG. 1. The feed-in slot 10 is connected to a feeding conduit 11 as best seen in FIG. 3. The feeding or supply line for the mixture of cossettes and juice is arranged below the tower bottom 9. Where several feeding slots 22 are located in the bottom 9 of the tower housing 2 as shown in FIG. 4, the supply conduit will preferably be a ring line and all the feeding slots 22 will be connected in common to such ring shaped or annular feed line 11, as shown in FIG. 2. The ring line 11 is connected to an intake port or conduit 12 connected to the cossette pump not shown.

The feed slots 10 or 22 extend over a considerable part of the radial distance between the inner wall of the housing 2 and the outer wall of the conveyor shaft 5, whereby a uniform supply and distribution of the cossettes juice mixture is assured over the surface of the bottom of the tower.

FIGS. 1 and 2 further illustrate the arrangement of a screening feed advance screw 13 supported in its respective housing so that the longitudinal axis of the feed screw means 13 extends in the radial direction relative to the tower. The radial outer end 16 of the feed screw means 13 is connected through a conduit 14 to receive cossettes and juice mixture from a point in the tower located upstream of the interconnection between the tower proper and the feed screw means 13, as viewed in the direction 15 of shaft rotation. This arrangement provides a further means for the fine control of the uniform cossettes juice mixture over the bottom surface of the tower because the feeding of the screw proper into the tower creates a suction in the direction of the arrow 17, shown in FIG. 1, whereby corresponding cossettes juice flows are generated which are radially effective and which influence in an advantageous manner, the uniform distribution of the cossettes juice mixture over the surface of the tower bottom.

Another advantage of the intensive motion of the cossettes juice mixture caused by the screening feed screw means 13 is seen in that it greatly facilitates the juice removal directly from the housing of the feed screw means 13. Thus, maximum juice quantities may be withdrawn from the bottom area of the tower without any difficulties by operatively connecting a plurality of feed screw means 13 to the bottom area of the tower housing 2. The juice withdrawal may thus be controlled either by a single feed screw means 13 of substantial dimensions or, if desired, by a plurality of smaller feed screw means, preferably evenly distributed about the circumference of the lower housing portion of the tower.

In those instances, where the tower bottom 9 does not comprise any screening at all, it is necessary to provide a sand discharging device 21 comprising a screen 18 and a sand catcher 19 arranged underneath the screen 18. The sand catcher 19 is connected to a discharge conduit 20.

By the above described combination of features according to the invention, it is possible to achieve a substantial improvement in the feed supply of the cossettes juice mixture into the tower as well as in the juice withdrawal from the tower and the bottom zone thereof. Thus, according to the invention, even the towers of maximum radial dimensions available today may be operated without any problems since a uniform radial distribution of the cossettes juice mixture is accomplished by the present feed in operation and the juice removal is optimized.

In operation, the cossettes juice mixture is supplied substantially over a central area between the inner surface of the tower housing and the conveyor shaft. Thus, the cossettes juice mixture is not required to travel any substantial distance in the radial direction, especially since the feed-in takes place through a slot 10 which extends at a slanted angle 10' relative to the tower radius R. The larger this slot is, the larger becomes the length over which the cossettes juice mixture is uniformly distributed initially over the surface of the tower bottom.

The slanted position of the slot 10 relative to the direction of the radius has the advantage that the distributor blade 7 or the scraper blade 8, which may be used in combination or alternatively depending on the type of bottom structure as a screen or partial screen, will not cover larger portions or areas of the feed-in slot 10 as the distributor 7 or scraper 8 is rotating and passes over the slot. Thus, only a minor surface area portion of the slot 10 will be covered by the distributor 7 or scraper 8 at any one instance. Yet another advantage of the slanted position of the feed-in slot 10 is seen in that it provides a possibility of influencing the feed supply. For example, it is possible to accomplish a retarding effect, for example, by making the opening area of the slot adjustable or to influence the flow direction of the cossettes juice mixture, either toward the conveyor shaft or toward the outer wall housing of the tower.

It has been found that it is most advantageous for a uniform cossettes distribution if the feed slot has a length which is larger than one half the distance between the tower housing 2 and the conveyor shaft 5. Further, the uniform distribution is facilitated if the slot or slots have a pie shape as shown in FIG. 4 with the wider end extending toward the tower housing wall. In this embodiment of the invention, larger quantities of cossettes juice mixture are supplied in areas having a larger diameter than in areas with a smaller diameter. In other words, the pie shape width will be adapted to the radial distance from the tower center.

Where a plurality of slots 22 are used, their angular spacing from each other should preferably be uniform and, as described, all slots would preferably be supplied from a single angular supply conduit 11 connected in common to all supply slots 22.

With regard to the screening feed screw means 13, it should be mentioned that the connection conduit 14 in combination with the operation of the feed screw proper, creates a suction effect in the bottom area of the tower which tends to draw the cossettes radially outwardly and such suction also facilitates the juice removal as described, especially where a plurality of such feed screws 13 with their respective conduits are distributed about the circumference of the bottom zone of the tower, whereby very large screening areas are made available for the juice removal laterally out of the tower side wall, whereby the tower bottom may be completely free of screening means or only limited screening areas may be provided in the tower bottom. This feature has the further advantage, especially in connection with towers of very large dimensions, that the entire construction and assembly may become more convenient and that statically more favorable conditions are accomplished. Moreover, according to the invention, the position of the screening feed screws 13 relative to the feed-in slots 10, may be coordinated in such a manner that their functions supplement each other in the uniform distribution of the cossettes juice mixture and that any cossettes accumulations are avoided. The radially extending cross flows in the bottom zone which are generated by the screening feed screw means 13 are an ideal means for influencing the cossettes distribution in the sense of a uniform feed advance over the entire bottom area of the tower.

Although the invention has been described with reference to specific example embodiments, it will be appreciated, that it is intended, to cover all modifications and equivalents within the scope of the appended claims.

What is claimed is:

1. A diffusion tower for sugar beet cossettes comprising a housing constructed as an upright hollow cylinder having a top and bottom, conveyor shaft means coaxially and concentrically supported for rotation in said cylinder housing, wing means secured to the outer surface of said conveyor shaft means, cossettes distributing means secured to the lower end of said conveyor shaft means, feed means for supplying a mixture of cossettes and juice into the tower at the lower end thereof, juice discharging means operatively connected to the lower tower end, pulp discharging means and extraction liquid supply means operatively connected to the upper end of said tower housing, said feed means comprising feed slot means arranged in said tower bottom between the conveyor shaft means and the housing, and feed conduit means operatively connected to the slot means.

2. The diffusion tower of claim 1, wherein said feed slot means are arranged at an angle relative to the radial direction of the tower.

3. The diffusion tower of claim 1, wherein said feed conduit means for said cossette and juice mixture are arranged below said tower bottom.

4. The diffusion tower of claim 1, wherein the length of said feed slot means is larger than half the distance between the tower housing and the conveyor shaft means.

5. The diffusion tower of claim 1, wherein said feed slot means have a wedge shape arranged so that the wider end points substantially toward the tower housing.

6. The diffusion tower of claim 1, wherein said feed slot means comprise a plurality of slots substantially uniformly spaced from each other around the bottom of the tower housing.

7. The diffusion tower of claim 6, wherein said cossette and juice mixture feed means comprise ring conduit means operatively connected in common to said plurality of feed slots.

8. The diffusion tower of claim 1, further comprising screening feed screw means operatively fastened to the outside of said housing for juice discharging from the tower, said screening feed screw means having a longitudinal axis extending radially to the tower, said screening feed screw means conveying in the direction toward the tower, feed conduit means having one end operatively connected to said tower housing at a point upstream of the connection of the feed screw means to the tower housing as viewed in the direction of rotation of said conveyor shaft means, said feed conduit means having a further end operatively connected to said screening feed screw means at the axially outer end thereof, for supplying cossettes and juice mixture out of the tower into said screening feed screw means for facilitating the juice removal from the tower.

9. The diffusion tower of claim 1, having baffle means secured to the inside wall of said hollow cylinder.

10. The diffusion tower of claim 1, wherein said slot means has a length larger than one half the radial spacing between the cylinder housing and the conveyor shaft.

11. A diffusion tower for sugar beet cossettes comprising a housing constructed as an upright hollow cylinder having a top and bottom, rotatable, driven conveyor shaft means arranged concentrically in said cylinder housing, conveyor wing means secured to the outer surface of said shaft means, cossettes distributing means secured to the lower end of said shaft means, feed means for supplying a mixture of cossettes and juice into the tower at the lower end thereof, juice discharging means operatively connected to the lower tower end, pulp discharging means and extraction liquid supply means operatively connected to the upper end of said tower housing, said apparatus further comprising screening feed screw means operatively secured to the outside of said housing at the lower end of the housing for discharging juice from the tower, said screening feed screw means having a longitudinal axis extending substantially radially to the tower, said screening feed screw means conveying in the direction into the tower, feed conduit means having one end operatively connected to said tower housing at a point upstream of the connection of the feed screw means to the tower housing as viewed in the direction of rotation of said shaft means, said feed conduit means having a further end operatively connected to said screening feed screw means at the axially outer end thereof for supplying cossettes and juice mixture out of the tower into said screening feed screw means for facilitating the juice removal from the tower, said diffusion tower further comprising feed slot means arranged in the bottom of the tower housing between the conveyor shaft means and the housing and feed conduit means operatively connected to the slot means.

12. The diffusion tower of claim 11, wherein said slot means are arranged at an angle relative to the radial direction of the tower.

13. The diffusion tower of claim 11, wherein said screening feed screw means and said slot means are positioned relative to each other to enhance their cooperation.

* * * * *